US009302886B2

(12) United States Patent
Tantis et al.

(10) Patent No.: US 9,302,886 B2
(45) Date of Patent: Apr. 5, 2016

(54) ELEVATOR DOOR COUPLER ASSEMBLY

(75) Inventors: Jean-Pierre Tantis, Bonny sur Loire (FR); Amine Badaoui, Briare (FR); Franky Mias, Les Bordes (FR); Philippe Ducas, Saint Firmin sur Loire (FR)

(73) Assignee: Otis Elevator Company, Farmington, CT (US)

( * ) Notice: Subject to any disclaimer, the term of this patent is extended or adjusted under 35 U.S.C. 154(b) by 582 days.

(21) Appl. No.: 13/643,629

(22) PCT Filed: May 17, 2010

(86) PCT No.: PCT/IB2010/001437

§ 371 (c)(1),
(2), (4) Date: Oct. 26, 2012

(87) PCT Pub. No.: WO2011/144957

PCT Pub. Date: Nov. 24, 2011

(65) Prior Publication Data

US 2013/0048433 A1 Feb. 28, 2013

(51) Int. Cl.

| | |
|---|---|
| ***B66B 13/12*** | (2006.01) |
| ***B66B 13/16*** | (2006.01) |
| ***B66B 13/20*** | (2006.01) |

(52) U.S. Cl.

CPC ..... *B66B 13/12* (2013.01); *B66B 13/20* (2013.01)

(58) Field of Classification Search

CPC ..... B66B 13/12; B66B 13/18; B66B 13/16; B66B 13/20

See application file for complete search history.

(56) References Cited

U.S. PATENT DOCUMENTS

| | | | |
|---|---|---|---|
| 2,517,713 | A | 8/1950 | Rissler |
| 4,313,525 | A | 2/1982 | McDonald |

(Continued)

FOREIGN PATENT DOCUMENTS

| | | | |
|---|---|---|---|
| CN | 201058783 | Y | 5/2008 |
| EP | 0892756 | B1 | 1/2002 |

(Continued)

OTHER PUBLICATIONS

International Search Report and Written Opinion of the International Searching Authority for International application No. PCT/IB2010/001437 dated Feb. 15, 2011.

(Continued)

*Primary Examiner* — William E Dondero
*Assistant Examiner* — Diem Tran
(74) *Attorney, Agent, or Firm* — Carlson, Gaskey & Olds

(57) ABSTRACT

An elevator door assembly includes car and hoistway door subassemblies. The car door subassembly includes: a car door, a door mover, and first and second vanes supported for movement relative to the car door. The hoistway door subassembly includes: a hoistway door; a locking member that selectively locks the hoistway door; and a coupler member associated with the locking member. When the car door is adjacent the hoistway door: the first vane moves into contact with the coupler member and causes the locking member to move into an unlocked position, prior to movement of the car and hoistway doors; and the second vane is retained in a non-blocking position by the coupler member. When the car door is not adjacent the hoistway door, movement of the car door toward the open position moves the second vane into a blocking position in which further movement of the car door is inhibited.

20 Claims, 5 Drawing Sheets

(56) References Cited

U.S. PATENT DOCUMENTS

| | | | | |
|---|---|---|---|---|
| 4,491,200 | A | 1/1985 | Thompson et al. | |
| 5,105,916 | A | 4/1992 | Steacy et al. | |
| 5,651,427 | A | 7/1997 | Kulak et al. | |
| 5,651,428 | A | 7/1997 | Ahigian et al. | |
| 5,732,796 | A | 3/1998 | Ahigian et al. | |
| 5,819,877 | A * | 10/1998 | Rivera et al. | 187/314 |
| 5,899,302 | A | 5/1999 | O'Donnell | |
| 5,918,706 | A | 7/1999 | Kowalczyk et al. | |
| 5,950,766 | A * | 9/1999 | Oberleitner | B66B 13/12 187/319 |
| 6,340,073 | B1 * | 1/2002 | Lee et al. | 187/309 |
| 6,446,759 | B1 | 9/2002 | Kulak et al. | |
| 7,252,179 | B2 | 8/2007 | Oberleitner | |
| 7,350,623 | B2 * | 4/2008 | Kinoshita et al. | 187/330 |
| 7,607,517 | B2 | 10/2009 | Karner et al. | |
| 2005/0139429 | A1 * | 6/2005 | Bisang | B66B 13/12 187/319 |
| 2006/0243535 | A1 * | 11/2006 | Kinoshita | B66B 13/20 187/319 |
| 2007/0205059 | A1 | 9/2007 | Badaoui et al. | |
| 2008/0000727 | A1 * | 1/2008 | Dziwak | 187/319 |
| 2008/0135344 | A1 * | 6/2008 | Pillin et al. | 187/314 |
| 2009/0114486 | A1 | 5/2009 | Ikonen et al. | |
| 2011/0186386 | A1 * | 8/2011 | Gilli | B66B 13/12 187/324 |
| 2012/0118676 | A1 * | 5/2012 | Utsunomiya | B66B 13/12 187/330 |
| 2012/0298453 | A1 * | 11/2012 | Fujii et al. | 187/330 |
| 2013/0105249 | A1 * | 5/2013 | Henseler | B66B 13/02 187/315 |
| 2013/0133985 | A1 * | 5/2013 | Reuter | B66B 13/12 187/319 |

FOREIGN PATENT DOCUMENTS

| | | | |
|---|---|---|---|
| JP | 50047346 | A | 4/1975 |
| JP | 7157248 | A | 6/1995 |
| JP | 2009007090 | A | 1/2009 |
| KR | 20020093533 | A | 12/2002 |
| WO | 2008078135 | A1 | 7/2008 |
| WO | 2008149456 | A1 | 12/2008 |

OTHER PUBLICATIONS

First Search by the State Intellectual Property Office of People's Republic China for CN Application No. 201080066819.8 dated Jan. 6, 2014.

* cited by examiner

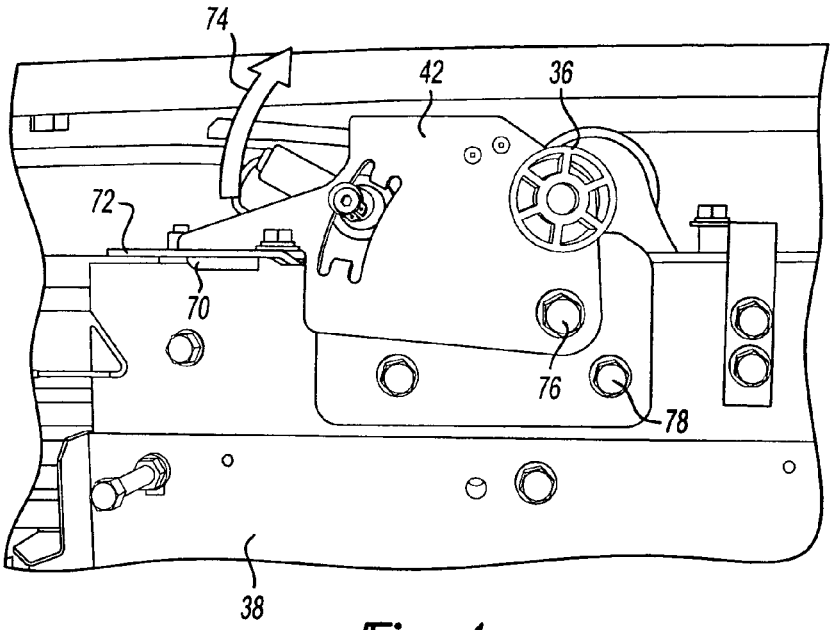
Fig 4
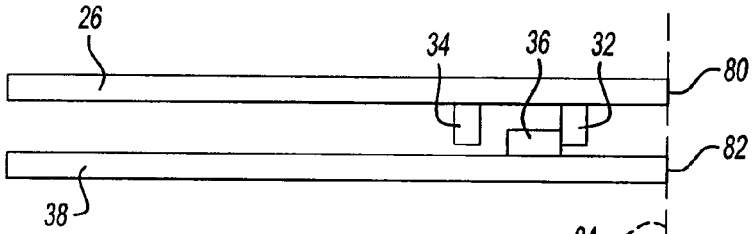
Fig 5A
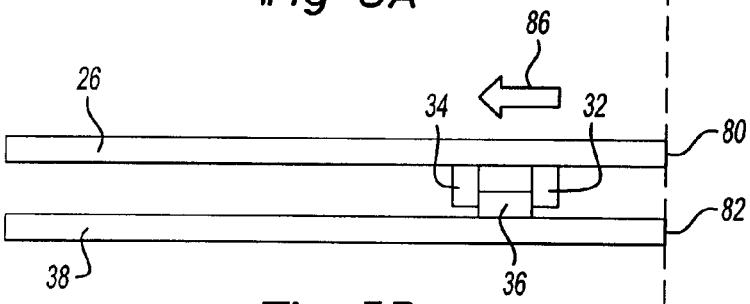
Fig 5B
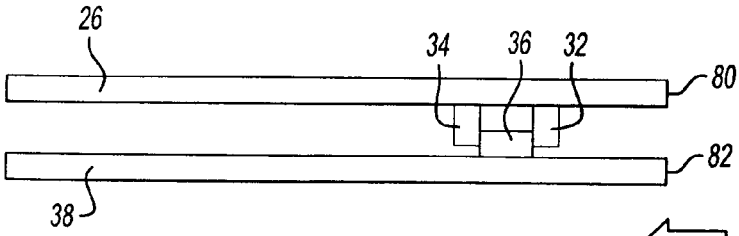
Fig 5C
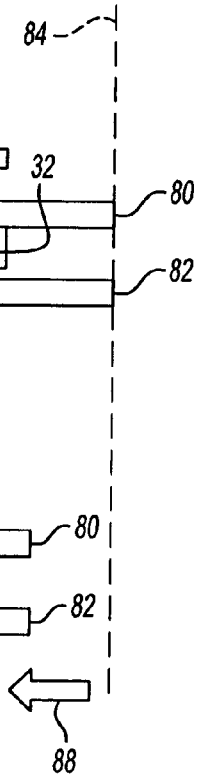

ELEVATOR DOOR COUPLER ASSEMBLY

BACKGROUND

Elevator systems are in widespread use for carrying passengers between various levels in buildings, for example. Access to an elevator car requires that elevator car doors open when the car is at a landing at which a passenger desires to board the elevator car, for example. Each landing includes hoistway doors that move with the elevator car doors between open and closed positions.

There are various known arrangements for coupling the elevator car doors to the hoistway doors so that the door mover that causes movement of the car doors also causes desired movement of the hoistway doors. Most arrangements include a set of vanes supported on the elevator car door structure and a set of rollers supported on the hoistway door structure. When the rollers are received adjacent the vanes, it is possible to move both doors together. The movement of the car doors includes one of the vanes pushing on one of the rollers to move the hoistway door in one direction and the other vane pushing on the other roller to move the hoistway door in the other direction.

Another feature of many elevator door systems is a deterrent vane that inhibits movement of the elevator car door unless the car is properly positioned at a landing. The coupling components associated with the hoistway door have to be present in order for the elevator car door to be able to open. If not, the deterrent vane moves into a position to inhibit the elevator car door from opening.

One drawback associated with previous elevator door coupler arrangements is that two vanes and two rollers are required to achieve the desired rigid link between the car door and the hoistway door and that an additional deterrent vane is required. One attempt at reducing the number of required components is shown in U.S. Pat. No. 6,446,759. That patent shows a door coupler arrangement that has only two vanes with one of them providing a deterrent function. One drawback associated with that configuration is that, as shown in FIGS. 9*a*-9*c*, the prior art car doors 200 always lead the hoistway doors 202 by several centimeters during movement from a closed position (FIG. 9*a*) to an open position (FIG. 9*c*). This requires additional hoistway clearance Δ on both sides of the elevator car in the hoistway to accommodate a longer travel distance for the car doors compared to the hoistway doors during a door opening procedure.

SUMMARY

An exemplary elevator door assembly includes a car door subassembly and a hoistway door subassembly. The car door subassembly includes: a car door, a door mover, and first and second vanes supported for movement relative to the car door. The hoistway door subassembly includes: a hoistway door; a locking member configured to selectively lock the hoistway door; and a coupler member associated with the locking member. When the car door is adjacent the hoistway door: the first vane is configured to be moved, relative to the car door, by the door mover so as to position the first vane in contact with the coupler member and thereafter to cause movement of the coupler member such that the locking member moves into an unlocked position prior to movement of the car door and the hoistway door from a closed position toward an open position; and the second vane is retained in a non-blocking position by the coupler member when the car door and the hoistway door move from the closed position toward the open position. When the car door is not adjacent the hoistway door, movement of the car door toward the open position is configured to move the second vane into a blocking position in which further movement of the car door is inhibited.

The various features and advantages of an example embodiment will become apparent to those skilled in the art from the following detailed description. The drawings that accompany the detailed description can be briefly described as follows.

BRIEF DESCRIPTION OF THE DRAWINGS

FIG. 4 diagrammatically illustrates an example hoistway door lock.

FIGS. 5*a*-5*c* schematically illustrate movement of selected features of the example door assembly.

DETAILED DESCRIPTION

Figure 1:
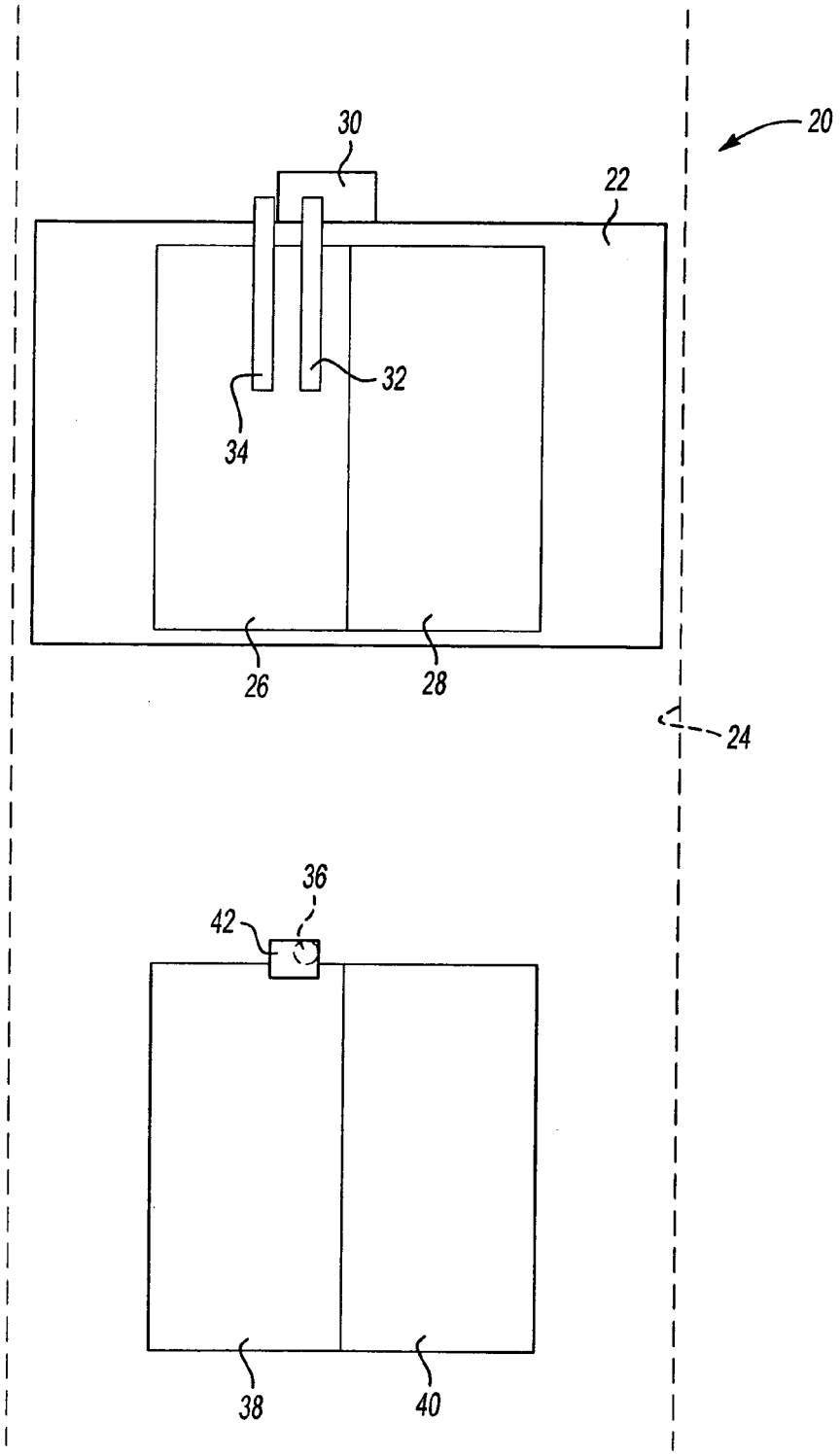
FIG. 1 schematically shows selected portions of an example elevator system including a door assembly designed according to an embodiment of this invention.

FIG. 1 schematically shows selected portions of an example elevator system 20. An elevator car 22 is situated for movement within a hoistway 24 in a known manner. The elevator car 22 includes car doors 26 and 28. A door mover 30 selectively causes movement of the car doors 26 and 28 between open and closed positions to allow access to the interior of the elevator car. The door mover 30 and the car doors 26 and 28 move with the elevator car as it travels vertically within the hoistway 24.

At least the door 26 includes a first vane 32 and a second vane 34 that cooperate with a coupler member 36 for coupling the elevator car doors 26 and 28 to hoistway doors 38 and 40 when the elevator car 22 is at the landing having those hoistway doors. When the doors are appropriately coupled together, the hoistway doors 38 and 40 move in unison with the elevator car doors 26 and 28.

In the example of FIG. 1, the coupler member 36 is part of a hoistway door lock 42 that selectively allows the hoistway doors to open only when the elevator car 22 is at the corresponding landing, for example.

Figure 2:
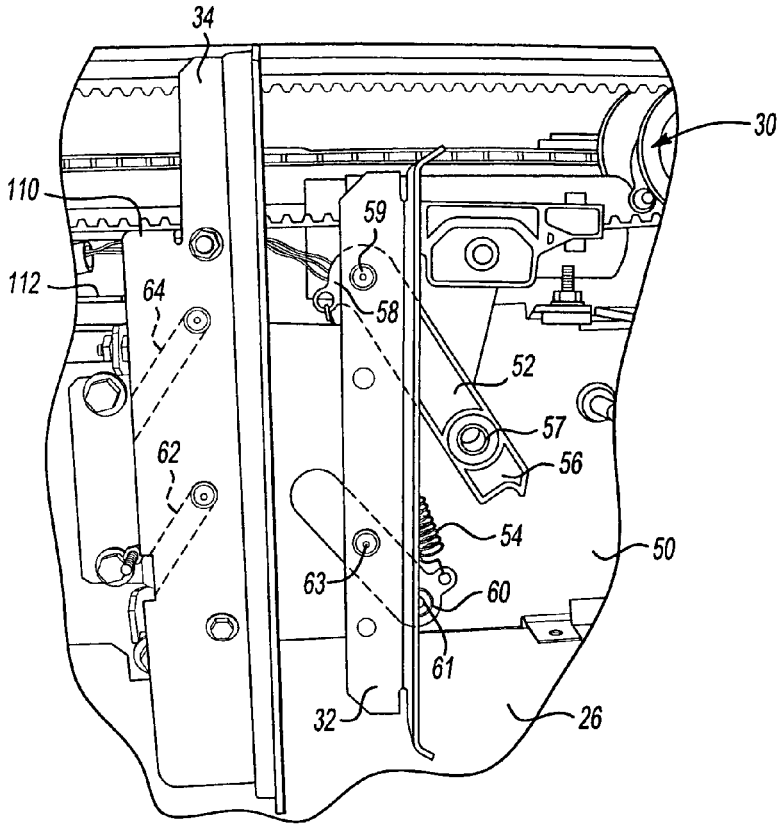
FIG. 2 diagrammatically illustrates selected components of an example door assembly.

FIG. 2 shows one example first vane 32 and an example second vane 34 each supported for movement with the car door 26. This example includes at least one mounting bracket 50 that is secured to a portion of the door 26 such as a door hanger or a door panel, for example. The first vane 32 is supported for at least some movement relative to the mounting bracket 50. In this example, a mounting arm 52 is pivotally mounted to the mounting bracket 50 at a point 57 such that the arm 52 is configured to be moveable relative to the mounting bracket 50 responsive to operation of the door mover 30 that is intended to move the car door 26 from a fully closed position toward an open position.

In this example, the mounting arm 52 is biased toward a first position that corresponds to the first vane 32 being in a position to allow the elevator car 22 to travel through the hoistway 34 without the vane 32 interacting with any coupler members 36. A biasing member 54, which comprises a coil spring in this example, urges the mounting arm 52 toward the first position. The door mover 30 overcomes the bias of the biasing member 54 to move the mounting arm 52 and the first vane 32 from the first position (e.g., toward the left in the illustration).

The example mounting arm 52 has one end 56 pivotally supported at the mounting point 57 on the mounting bracket 50. An opposite end 58 of the mounting arm is pivotally connected with the first vane 32 at a point 59 such that the first vane 32 is moveable relative to the car door 26 along a partially arcuate path from the first position responsive to operation of the door mover 30. This example includes another mounting arm 60 associated with the first vane 32. This mounting arm 60, which is pivotally connected to the mounting bracket 50 at a first point 61 and is pivotally connected to the first vane 32 at a second point 63, facilitates smooth and quiet movement of the first vane 32 relative to the mounting bracket 50 and the car door 26 at the beginning of an opening procedure and again at the end of a closing procedure.

Figure 8A:
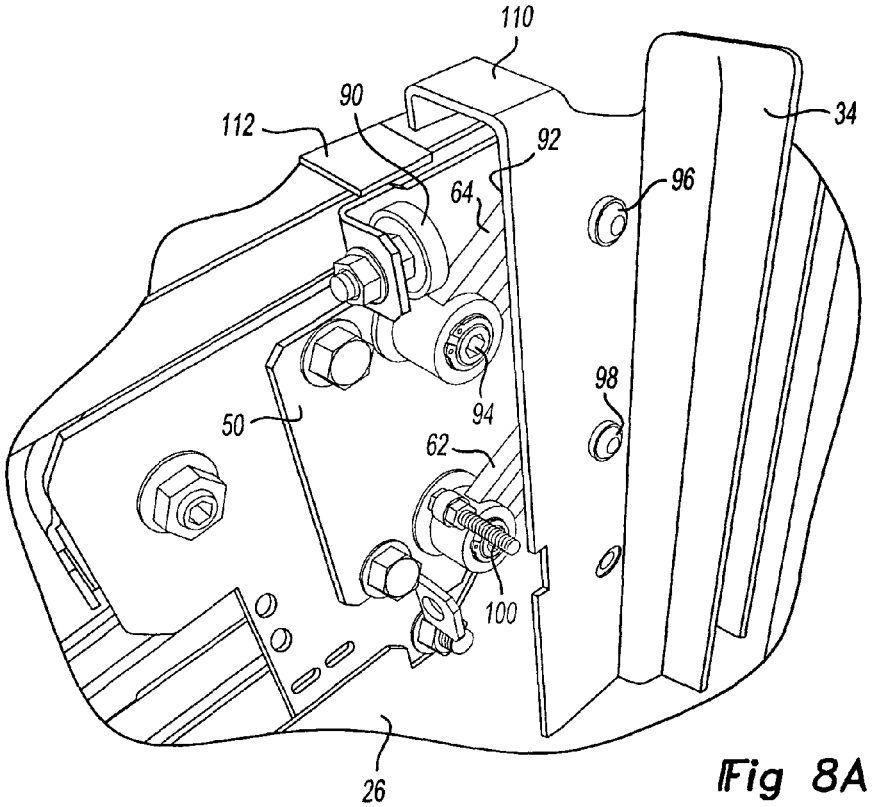
FIGS. 8*a* and 8*b* diagrammatically illustrate selected features of the example deterrent vane from opposite viewpoints, respectively.

The second vane 34 has second mounting arms 62 and 64, which are pivotally mounted to both the mounting bracket 50 and the second vane 34 at pivot points 94, 96, 93, 100 (shown best in FIG. 8*a*). The second mounting arms 62, 64 facilitate movement of the second vane 34 relative to the mounting bracket 50 and the car door 26. The second vane serves a deterrent or blocking function to inhibit the car door 26 from opening if the coupler member 36 is not properly situated relative to the vanes 32 and 34. The way in which the example second vane 34 performs its blocking function is described below.

Figure 3:
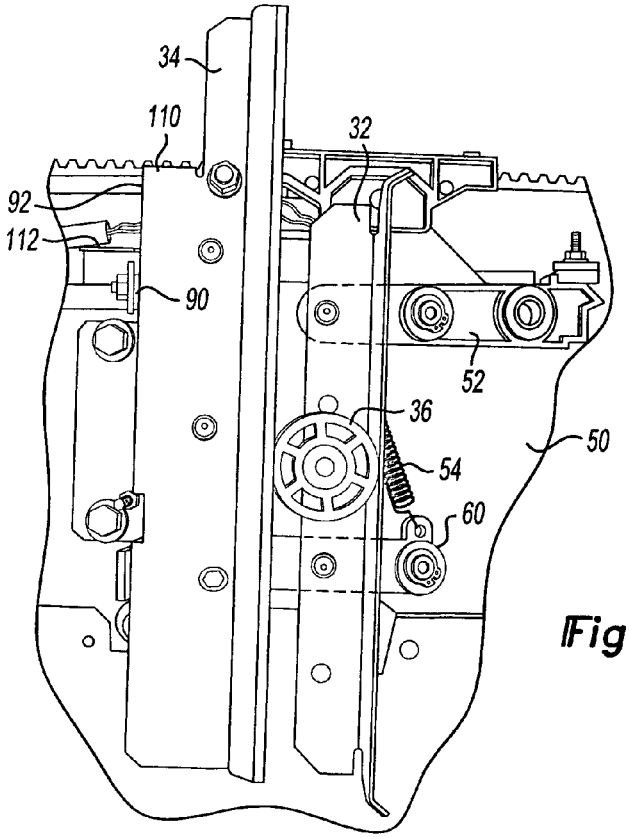
FIG. 3 diagrammatically illustrates the example of FIG. 2 in a coupling condition for causing movement of a hoistway door with an elevator car door.
Figure 6A:
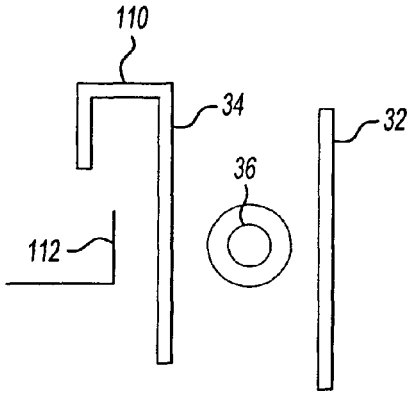
FIGS. 6*a* and 6*b* schematically illustrate a feature of an example deterrent vane during a door opening procedure.
Figure 6B:
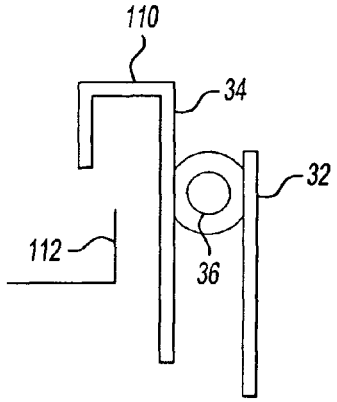

As shown in FIG. 3, the coupler member 36 of the hoistway doors 38 and 40 is received between the first vane 32 and the second vane 34 when the elevator car 22 is properly positioned at a landing including the hoistway doors 38 and 40. When the coupler member 36 is received between the vanes 32 and 34, the second vane 34 allows the car door 26 to open. The presence of the coupler member 36 inhibits the second vane 34 from performing its blocking function and the car door 26 is free to move responsive to operation of the door mover 30.

FIG. 4 shows an example hoistway door lock 42. In this example, the coupler member 36, which comprises a single roller, is fixedly situated on a portion of the door lock 42. A locking tab 70 is at least partially received through an opening in a locking plate 72 that is situated to remain in a fixed position relative to the structure surrounding the example hoistway door 38. When the locking tab is in a position to engage the locking plate 72, the hoistway door 38 is locked.

In this example, the door mover 30 causes an initial movement of the first vane 32 relative to the car door 26 (e.g., the mounting arms 52 and 60 pivot relative to the bracket 50) when the doors should be opened. The first vane 32 contacts the coupler member 36 and moves it (to the right in FIG. 4) toward the second vane 34. Such movement of the coupler member 36 causes the door lock 42 to rotate as schematically shown by the arrow 74 so that the locking tab 70 is moved clear of the locking plate 72 and the hoistway door 38 is unlocked. In this example, the door lock 42 pivots about a pivot axis 76. The illustrated example includes a mounting plate or bracket 78 that secures the door lock structure to a selected portion of the hoistway door 38 such as a hanger, for example. The door lock 42 moves relative to the door 38 as the locking tab 70 moves into or out of a locking position. The door lock 42 moves with the hoistway door 38 as the door moves between open and closed positions.

Figure 9A:
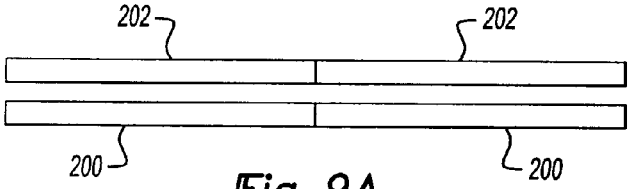
Fig 9A PRIOR ART
FIG. 9*a*-9*c* schematically illustrate movement of an elevator door assembly according to the prior art.
Figure 9B:
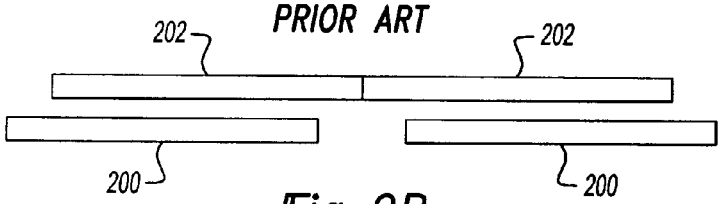
Fig 9B PRIOR ART
Figure 9C:
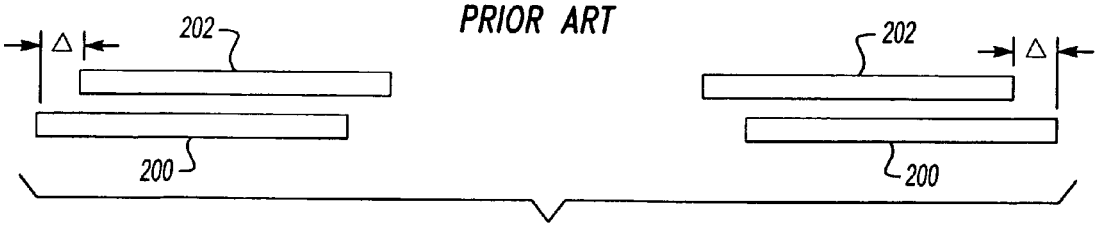
Fig 9C PRIOR ART

In the prior art elevator door system of FIGS. 9*a*-9*c*, the car door 200 and hoistway door 202 are in a fully closed position in FIG. 9*a*. As shown in FIG. 9*b*, the car door 200 begins to move toward an open position before the hoistway door 202 begins to move. The car door, therefore, leads the hoistway door in the opening direction and trails the hoistway door in the closing direction. This difference in door movement and position has an associated disadvantage in that more hoistway clearance space Δ on either side of the elevator car is required to accommodate the further travel of the car door in the opening direction when the doors reach the fully open position shown in FIG. 9*c*. If the travel of the car door is a few centimeters more than that of the hoistway door and the doors open in both directions on opposite sides of the entrance, then twice the space of the difference in travel distance is required in the hoistway to accommodate the additional travel distance of the car doors.

In contrast to the unaligned movement of the doors in the prior art system of FIGS. 9*a*-9*c*, FIGS. 5*a*-5*c* schematically illustrate a feature of the example embodiment in which the doors remain aligned when moving between closed and open positions. FIG. 5*a* shows the elevator car door 26 fully closed and the hoistway door 38 fully closed. The car door 26 includes an edge 80 and the hoistway door 38 includes an edge 82. The edges 80 and 82 are received against a surface (schematically represented at 84) when the doors are in a fully closed position. In FIG. 5*a*, the coupler member 36 is received between the first vane 32 and the second vane 34 when the elevator car 22 is at a landing including the hoistway door 38.

FIG. 5*b* shows initial movement of the first vane 32 relative to the door 26 responsive to initial operation of the door mover 30 at the beginning of a door opening procedure. The first vane 32 moves as schematically shown by the arrow 86 (to the left in the illustration) until the coupler member 36 has moved into contact with the second vane 34. During this initial movement of the first vane 32 and the coupler member 36, the door lock 42 is unlocked. The edges 80 and 82 of the doors 26 and 38 remain stationary during this stage of the opening procedure.

As can be appreciated from FIG. 5*c*, the door mover 30 continues to cause movement of the first vane 32, which causes the doors 26 and 38 to begin to move from the fully closed position toward an open position as schematically shown by the arrow 88. Once the door lock 42 is unlocked, the doors 26 and 38 are free to move together. The presence of the coupler member 36 against the second vane 34 inhibits the second vane 34 from moving into a blocking position where it otherwise would have inhibited the car door 26 from opening.

As shown in FIG. 5*c*, one feature of this example is that the edges 80 and 82 of the doors remain aligned with each other throughout all movement of the doors 26 and 38 such that there is no relative movement between the doors 26 and 38. Maintaining the doors aligned without relative movement between them during an opening procedure reduces the amount of space needed within the hoistway to accommodate the doors. This feature provides space savings and/or corresponding cost savings within the hoistway 24. More specifically, if the overall building size is maintained, the building owner will benefit by having additional rentable space due to the smaller hoistway. Similarly, if the overall building size is reduced by an amount corresponding to the reduction in hoistway size, the building owner will benefit from reduced construction costs.

Every reduction in required building space for an elevator system is an advantage that enhances the economies associated with the elevator system. Therefore, the illustrated example provides cost and spacing saving advantages compared to other door coupler arrangements.

During door movement toward an open position, the first vane 32 pushes on the coupler member 36 responsive to operation of the door mover 30. The second vane 34 pushes on the coupler member 36 responsive to operation of the door mover 30 urging the car doors 26, 28 toward a fully closed position. As shown in FIGS. 3 and 8, the mounting bracket 50 supports a stop member 90 that abuts the mounting arm 64. The stop member 90 provides support to maintain the second vane 34 in a desired position as the doors move toward a closed position (e.g., to the right in FIG. 3). The stop member 90 facilitates the second vane 34 operating differently than previous deterrent vanes. In this example, the second vane 34 is a deterrent vane that is capable of inhibiting undesired opening of the car door 26 and is a coupler vane that is responsible for interacting with the coupler member 36 for purposes of moving the elevator car door 26 and the hoistway door 38 together between open and closed positions.

Figure 7:
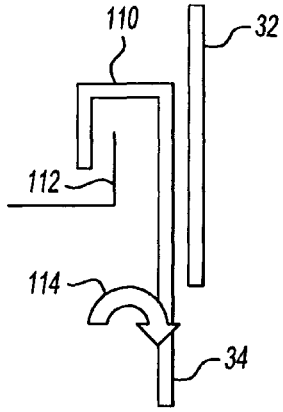
FIG. 7 schematically illustrates another feature of the example deterrent vane for inhibiting an elevator car door from opening under selected conditions.
Figure 8B:
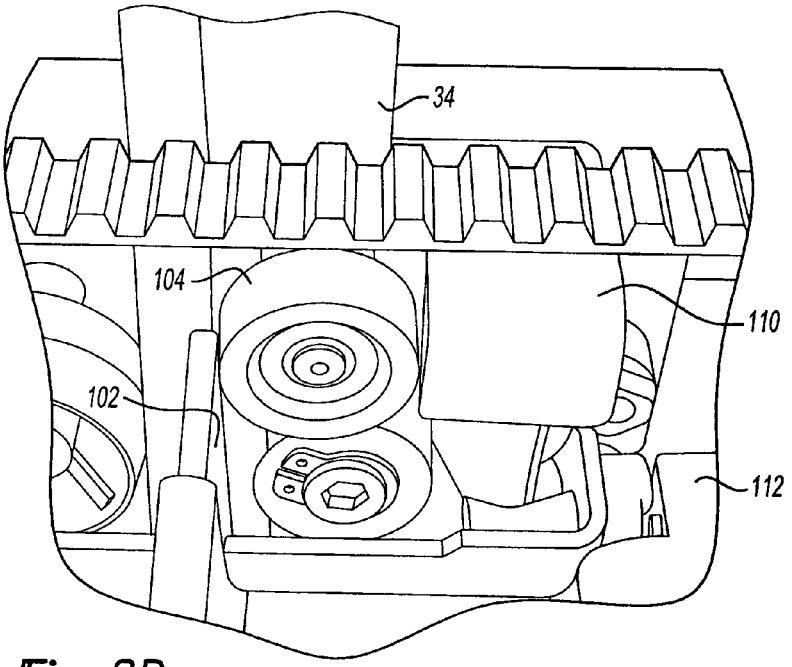

As schematically shown in FIG. 7 and diagrammatically in FIGS. 8*a* and 8*b*, the second vane 34 has a blocking member 110 that can engage a blocking feature 112 depending on the position of the second vane 34. The blocking feature comprises a rigid surface or tab on a bracket that remains stationary relative to the structure of the elevator car 22. In one example, the blocking feature is part of a bracket that is fixed to the lintel of the car door assembly.

The second vane 34 is in a blocking position when the blocking member 110 engages the blocking feature 112. When the coupler member 36 is between the vanes 32 and 34, the second vane 34 is unable to move relative to the mounting bracket 50 into the blocking position during the door opening and closing procedure.

If, on the other hand, the coupler member 36 is not between the vanes, any movement of the car door 26 toward an open position will cause the mounting arms 62 and 64 and the second vane 34 to move into a blocking position to inhibit the car door 26 from opening. As can be appreciated from FIG. 8*a*, the mounting arms 62 and 64 have ends that are pivotally coupled with the mounting bracket 50 and the second vane 34. One end of the mounting arm 64 pivots about a pivot axis 94 and the other end is pivotally coupled with the second vane 34 at 96. The other mounting arm 62 is similarly situated with one end at 98 coupled to the second vane 34 and an opposite end at 100 coupled to the mounting bracket 50.

As best appreciated from FIG. 8*b*, a ramp member 102, which is fixedly mounted to the car 22, urges the second vane 34 out of the blocking position as the car door 26 approaches the closed position. In this example, a roller 104 supported on the second vane 34 follows the ramp 102, which urges the second vane 34 out of the blocking position (as illustrated). As the door 26 moves to the fully closed position, the roller 104 rolls upward (according to the drawing) along the surface of the ramp 102 and that moves the second vane 34 upward. Once the door 26 is closed, the car mounted ramp member 102 maintains the second vane 34 in that non-blocking position. When the car door 26 begins to open, the roller 104 tends to move down along the ramp member 102 and the second vane 34 is able to fall into the blocking position under the influence of gravity, if the coupler member 36 is not between the first vane 32 and the second vane 34.

If the coupler member 36 is not present when the car doors 26, 28 begin to open the second vane 34 is allowed, under force of gravity, to move as schematically shown by the arrow 114 in FIG. 7 into the blocking position in which the blocking member 110 engages the blocking feature 112 (e.g., a tab or a rigid surface) that remains in a fixed position relative to the elevator car 22. More specifically, if coupler member 36 is not present when the car doors 26, 28 begin to open, roller 104 rolls down ramp 102 such that the blocking member 110 falls into the stationary blocking feature on the car 22, thereby inhibiting further lateral movement of the second vane 34 and, therefore, the door 26. In other words, contact between the blocking member 110 and the blocking feature 112 inhibits the car door 26 from moving out of the closed position toward an open position. In this way, the second vane 34 operates as a deterrent vane to inhibit the door 26 from opening in an unauthorized or undesired manner.

The example second vane 34 allows for eliminating several door assembly components compared to previous designs. Two coupler vanes and a third deterrent vane are usually included in a door coupler assembly. With the illustrated example, one of those vanes is eliminated along with supporting structure and, instead, the second vane 34 integrates a coupler vane function and a deterrent vane function into a single vane. Additionally, only a single roller as the coupler member 36 is required compared to twice as many in previous designs.

By combining the coupling and deterrent functions into the single second vane 34, the illustrated example provides savings by reducing parts and labor, for example. The additional feature of moving the first vane 32 relative to the car door at the beginning of an opening procedure allows for avoiding relative movement between the elevator car door and the hoistway door during an opening procedure, which provides space and cost savings. Another feature of the illustrated example is that only a single roller coupler member is required and that coupler member is associated with the hoistway door lock to facilitate unlocking the door lock when needed.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator door assembly, comprising:

a car door subassembly comprising:

a car door;

a first vane supported for movement relative to the car door;

a second vane supported for movement relative to the car door; and a door mover;

a hoistway door subassembly comprising:

a hoistway door;

a locking member configured to selectively lock the hoistway door; and a coupler member associated with the locking member, wherein, when the car door is in a position adjacent the hoistway door:

the first vane is configured to be moved, relative to the car door, by the door mover so as to position the first vane in contact with the coupler member and thereafter to cause movement of the coupler member such that the locking member moves into an unlocked position prior to movement of the car door and the hoistway door from a closed position toward an open position; and the second vane is retained in a non-blocking position by the coupler member when the car door and the hoistway door move from the closed position toward the open position, and wherein, the second vane moves into a blocking position in which further movement of the car door is inhibited when the car door is in another position different than the position adjacent the hoistway door and the car door moves toward the open position.

2. The assembly of claim 1, wherein the car door has a car door edge that is received adjacent another surface when the car door is in the closed position;

the hoistway door has a hoistway door edge that is received adjacent another surface when the hoistway door is in the closed position; and the hoistway door edge and the car door edge remain aligned with each other as the car door and the hoistway door move together from the closed position toward the open position.

3. The assembly of claim 1, wherein, the car door and the hoistway door move together from the closed position toward the open position.

4. The assembly of claim 1, wherein movement of the first vane relative to the car door occurs prior to the first vane moving with the car door when the car door is in the closed position.

5. The assembly of claim 1, wherein the car door subassembly comprises at least one bracket supported to remain stationary relative to the car door;

at least one moveable arm having one end that pivots relative to the at least one bracket and a second end connected to the first vane such that the first vane is moveable relative to the car door, the at least one moveable arm moving relative to the car door from a first position responsive to operation of the door mover.

6. The assembly of claim 5, wherein contact between the first vane and the coupler member restricts movement of the first vane and the at least one moveable arm beyond a second position.

7. The assembly of claim 5, the car door subassembly comprising a biasing member that biases the at least one moveable arm into the first position to return the at least one moveable arm to the first position as the car door moves into the closed position.

8. The assembly of claim 5, the car door subassembly comprising a plurality of second arms supporting the second vane such that the second vane is moveable relative to the at least one bracket, the second vane being moveable from the non-blocking position to the blocking position in which a blocking member on the second vane cooperates with a blocking feature near the car door to inhibit movement of the car door from the closed position, and wherein the coupler member inhibits the second vane from moving into the blocking position when the coupler member is between the first vane and the second vane.

9. The assembly of claim 8, wherein the car door subassembly comprises at least one stopper supported on the at least one bracket in a position to abut at least one of the plurality of second arms on a side of the one second arm that faces a direction of car door movement toward the open position.

10. The assembly of claim 8, wherein the plurality of second arms are supported on the at least one bracket such that the plurality of second arms move in a direction to urge the second vane into the blocking position responsive to the car door being urged to move from the closed position toward the open position.

11. The assembly of claim 8, wherein the blocking member comprises a tab on the second vane and the blocking feature comprises a surface that the tab engages to inhibit movement of the car door toward the open position.

12. The assembly of claim 8, wherein the plurality of second arms are situated such that the second vane tends to move into the blocking position under influence of gravity.

13. The assembly of claim 1, wherein the coupler member is a single roller.

14. The assembly of claim 13, wherein the single roller is supported on a portion of the locking member such that an initial movement of the door mover causes movement of the single roller responsive to contact with the first vane, the movement of the single roller causing movement of a portion of the door lock into an unlocked position.

15. The assembly of claim 1, wherein contact between the first vane and the coupler member facilitates movement of the car door and the hoistway door toward the open position and contact between the second vane and the coupler member facilitates movement of the car door and the hoistway door toward the closed position.

16. The assembly of claim 1, wherein, when the car door is adjacent the hoistway door, the coupling member is positioned between the first vane and the second vane.

17. An elevator system comprising:

a hoistway comprising a hoistway door assembly comprising:

a hoistway door;

a locking member configured to selectively lock the hoistway door; and a coupler member associated with the locking member, a car configured to move in the hoistway, the car comprising a car door assembly comprising:

a car door;

a first vane supported for movement relative to the car door;

a second vane supported for movement relative to the car door; and a door mover;

wherein, when the car door is in a position adjacent the hoistway door:

the first vane is configured to be moved, relative to the car door, by the door mover so as to position the first vane in contact with the coupler member and thereafter to cause movement of the coupler member such that the locking member moves into an unlocked position prior to movement of the car door and the hoistway door from a closed position toward an open position; and the second vane is retained in a non-blocking position by the coupler member when the car door and the hoistway door move from the closed position toward the open position, and wherein, when the car door is in another position different than the position adjacent the hoistway door, the second vane moves into a blocking position in which further movement of the car door is inhibited if the car door moves toward the open position.

18. The elevator of claim 17, wherein contact between the first vane and the coupler member facilitates movement of the car door and the hoistway door toward the open position and contact between the second vane and the coupler member facilitates movement of the car door and the hoistway door toward the closed position.

19. The elevator of claim 17, wherein, when the car door is adjacent the hoistway door, the coupling member is positioned between the first vane and the second vane.

20. The elevator of claim 17, the car comprising a ramp member that urges the second vane out of the blocking position as the car door moves into the closed position.

* * * * *